US011617395B2

(12) United States Patent
Farine

(10) Patent No.: US 11,617,395 B2
(45) Date of Patent: Apr. 4, 2023

(54) AEROSOL-GENERATING DEVICE AND METHOD FOR CONTROLLING A HEATER OF AN AEROSOL-GENERATING DEVICE

(71) Applicant: Philip Morris Products S.A., Neuchatel (CH)

(72) Inventor: Marie Farine, Sugiez (CH)

(73) Assignee: Philip Morris Products S.A., Neuchatel (CH)

( * ) Notice: Subject to any disclaimer, the term of this patent is extended or adjusted under 35 U.S.C. 154(b) by 285 days.

(21) Appl. No.: 16/768,364

(22) PCT Filed: Nov. 26, 2018

(86) PCT No.: PCT/EP2018/082522
§ 371 (c)(1),
(2) Date: May 29, 2020

(87) PCT Pub. No.: WO2019/105879
PCT Pub. Date: Jun. 6, 2019

(65) Prior Publication Data

US 2020/0367569 A1 Nov. 26, 2020

(30) Foreign Application Priority Data

Nov. 30, 2017 (EP) ..... 17204728

(51) Int. Cl.
*A24F 13/00* (2006.01)
*A24F 17/00* (2006.01)
(Continued)

(52) U.S. Cl.
CPC ..... *A24F 40/46* (2020.01); *A24F 40/10* (2020.01); *A24F 40/30* (2020.01); *A24F 40/42* (2020.01); *A24F 40/57* (2020.01)

(58) Field of Classification Search
CPC ..... A24F 40/10; A24F 40/30; A24F 40/42; A24F 40/46; A24F 40/57
See application file for complete search history.

(56) References Cited

U.S. PATENT DOCUMENTS 10,405,580 B2 * 9/2019 Karies ..... A61M 11/042
2014/0014125 A1 1/2014 Fernando et al.
(Continued)

FOREIGN PATENT DOCUMENTS

CN 104254258 A 12/2014
CN 104470386 A 3/2015
(Continued)

OTHER PUBLICATIONS

Combine Russian Federation Office Action and Search Report dated Dec. 1, 2021 in Russian Federation Patent Application No. 2020120945/03 (035752) (with English translation), 12 pages
(Continued)

*Primary Examiner* — Abdullah A Riyami
*Assistant Examiner* — Thang H Nguyen
(74) *Attorney, Agent, or Firm* — Oblon, McClelland, Maier & Neustadt, L.L.P.

(57) ABSTRACT

A method of controlling a heater in an aerosol-generating device is provided, the device including: a heater including a heating element configured to heat an aerosol-forming substrate, and a power source configured to provide power to the heating element; and the method including the steps of: controlling power provided to the heating element such that in a first phase, power is provided to increase a temperature of the heating element from an initial temperature to a first temperature, and in a second phase, power is provided to decrease the temperature of the heating element below the first temperature to a second temperature, the power being provided to the heating element during the first
(Continued)

phase is increased at least once during a duration of the first phase, and aerosol is produced during the second phase.

15 Claims, 3 Drawing Sheets

(51) Int. Cl.

| | |
|---|---|
| ***A24F 25/00*** | (2006.01) |
| ***A24F 40/46*** | (2020.01) |
| ***A24F 40/10*** | (2020.01) |
| ***A24F 40/57*** | (2020.01) |
| ***A24F 40/30*** | (2020.01) |
| ***A24F 40/42*** | (2020.01) |

(56) References Cited

U.S. PATENT DOCUMENTS

| | | | | |
|---|---|---|---|---|
| 2014/0299141 | A1 | 10/2014 | Flick | |
| 2015/0359263 | A1* | 12/2015 | Bellinger | H05B 1/0244 392/394 |
| 2016/0331040 | A1 | 11/2016 | Nakano et al. | |
| 2017/0150758 | A1 | 6/2017 | Fernando et al. | |
| 2018/0020735 | A1* | 1/2018 | Bilat | A24F 40/50 131/328 |
| 2018/0084608 | A1 | 3/2018 | Bernauer et al. | |
| 2019/0167923 | A1* | 6/2019 | Kessler | A61M 15/0065 |
| 2020/0046025 | A1* | 2/2020 | Otiaba | A24F 40/46 |
| 2020/0120988 | A1* | 4/2020 | Qiu | A24F 40/50 |
| 2020/0237004 | A1* | 7/2020 | Larsen | A24F 40/20 |
| 2021/0084986 | A1* | 3/2021 | Hepworth | A24F 40/50 |
| 2021/0137167 | A1* | 5/2021 | Aoun | H05B 6/065 |

FOREIGN PATENT DOCUMENTS

| | | | |
|---|---|---|---|
| CN | 105302223 | A | 2/2016 |
| CN | 205947116 | U | 2/2017 |
| CN | 106793833 | A | 5/2017 |
| CN | 107105793 | A | 8/2017 |
| CN | 107296301 | A | 10/2017 |
| EP | 2 454 956 | A1 | 5/2012 |
| EP | 3 692 829 | A1 | 8/2020 |
| JP | 2014-500017 | A | 1/2014 |
| JP | 2014-530632 | A | 11/2014 |
| JP | 2017-113016 | A | 1/2017 |
| RU | 2 613 785 | C2 | 3/2017 |
| WO | WO 2013/060781 | A1 | 5/2013 |
| WO | WO 2014/040988 | A2 | 3/2014 |
| WO | WO 2014/102091 | A1 | 7/2014 |
| WO | WO 2015/197627 | A1 | 12/2015 |
| WO | WO 2016/166064 | A1 | 10/2016 |
| WO | WO 2017/108983 | A1 | 6/2017 |
| WO | WO 2017/108987 | A1 | 6/2017 |
| WO | WO 2017/108991 | A1 | 6/2017 |
| WO | WO 2017/108992 | A1 | 6/2017 |
| WO | WO 2018/099999 | A1 | 6/2018 |
| WO | WO 2018/224677 | A2 | 12/2018 |
| WO | WO 2019/011937 | A1 | 1/2019 |

OTHER PUBLICATIONS

International Search Report and Written Opinion dated Feb. 1, 2019 in PCT/EP2018/082522 filed Nov. 26, 2018.

Extended European Search Report dated Nov. 30, 2022 in counterpart European Patent Application No. 22 18 5325, total 9 pages.

Notification of Reasons for Refusal dated Nov. 14, 2022 in Japanese Patent Application No. 2020-529464 filed on Nov. 26, 2018, (with translation, total 6 pages).

Donglai, Z. et al., "Electronic Cigarettes", Aug. 31, 2015, total 5 pages. URL: https://img.duxiu.com/n/jpgfs/book/base/96088097/adb20bfde13c4df787b2f2facaaa90dc/1e622d4d90e33a48800610380b2d84c7.shtml.

Fuxu, L., "Design and Implementation of Portable Intelligent Atomizer", Chinese Masters' Theses Full-text Database, Volume of Engineering Science and Technology. No. 03, Mar. 15, 2017, total 76 pages.

Chinese Office Action dated Feb. 2, 2023 in Chinese Patent Application No. 201880073084.8, total 21 pages, with English translation.

* cited by examiner

AEROSOL-GENERATING DEVICE AND METHOD FOR CONTROLLING A HEATER OF AN AEROSOL-GENERATING DEVICE

CROSS-REFERENCE TO RELATED APPLICATIONS

This application is a U.S. national stage application of PCT/EP2018/082522, filed on Nov. 26, 2018, which is based upon and claims the benefit of priority under 35 U.S.C. § 119 to European patent application no. 17204728.4, filed Nov. 30, 2017, the entire contents of each of which are incorporated herein by reference.

TECHNICAL FIELD

The present invention relates to an aerosol-generating device comprising a cartridge containing an aerosol-forming substrate, and a method for controlling a heater of an aerosol-generating device.

In particular, the invention relates to a method for controlling a heater of an aerosol-generating device during the initial phases, wherein the cartridge containing the aerosol-forming substrate is heated to a temperature at which aerosol is produced as fast as possible, while avoiding overheating of the aerosol-forming substrate, and unnecessary energy losses due to the incapacity of the cartridge material to absorb heat efficiently.

DESCRIPTION OF THE RELATED ART

It is generally desirable for aerosol-generating devices to generate an aerosol with the desired properties as soon as possible after activation of the device. For a satisfactory consumer experience of an aerosol-generating device the 'time to first puff' is considered to be an important factor. Consumers often do not want to wait for a prolonged period of time following activation of the device before being able to take a first puff. For this reason, a particular power may be supplied to the heating element when a device is activated to raise it to a working temperature as quickly as possible. However, it has been found that initially supplying a high or maximum power to a heater to increase the temperature of the cartridge quickly is often not an optimal solution. For example, the heating may be inefficient, resulting in energy losses due to the incapacity of the cartridge material to absorb heat efficiently. In addition, the cartridge, or its parts, or the aerosol-forming substrate contained in the cartridge, may be overheated.

It would be desirable to provide an aerosol-generating device and system that is configured to generate aerosol quickly following activation of the device, without unnecessary loss of energy, and with a reduced risk of overheating the cartridge and/or the aerosol-forming substrate.

SUMMARY

In a first aspect, the disclosure provides a method of controlling aerosol production in an aerosol-generating device, the device comprising: a heater comprising at least one heating element configured to heat an aerosol-forming substrate; and a power source for providing power to the heating element; the method comprising the steps of controlling the power provided to the heating element such that in a first phase power is provided to increase the temperature of the heating element from an initial temperature to a first temperature, and in a second phase power is provided to decrease the temperature of the heating element below the first temperature to a second temperature, wherein the power provided to the heating element during the first phase is increased at least once during the duration of the first phase; and wherein aerosol is produced during the second phase.

In the first phase, the power supplied to the heating element is increased to increase the temperature of the heating element from an initial temperature to a first temperature. In particular, the power provided to the heating element is increased at least once during the duration of the first phase. In other words, the power provided to the heating element is increased gradually during the first phase to gradually increase the temperature of the heating element. The gradual increase in power may be incremental, comprising one or more steps or increments. The gradual increase in power may comprise a continuous increase over at least a portion of the first phase.

BRIEF DESCRIPTION OF THE DRAWINGS

Embodiments of the invention will now be described, by way of example only, with reference to the accompanying drawings, in which.

DETAILED DESCRIPTION

Figure 1:
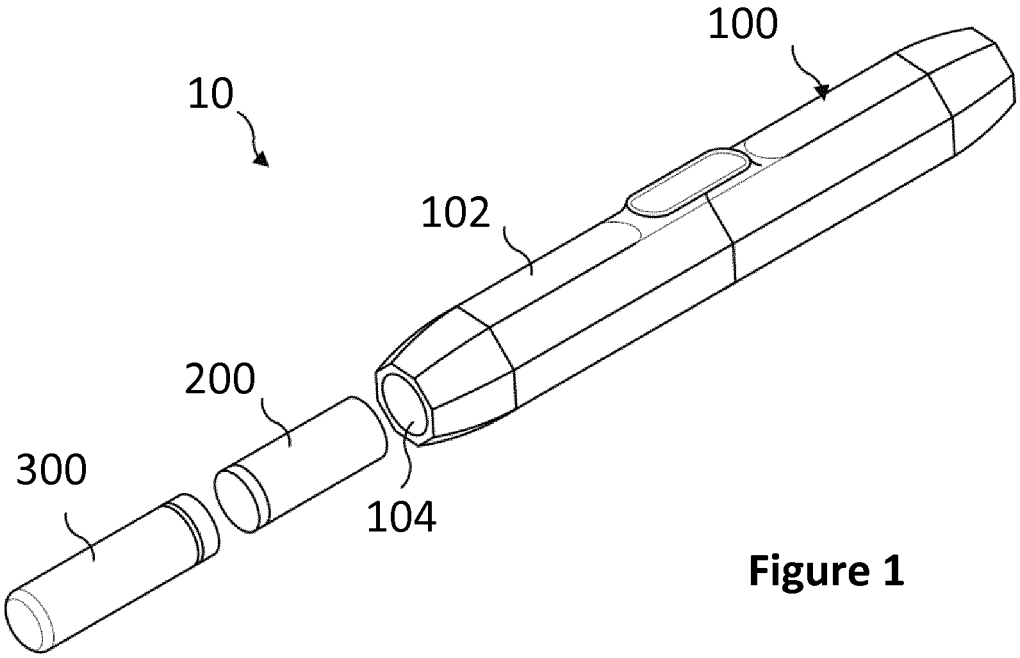
FIG. 1 shows an aerosol-generating system according to the invention.

It has been found that gradually increasing the power supplied to the heating element to gradually increase the temperature of the heating element during the first phase may provide the same or a substantially similar temperature increase in the aerosol forming substrate at the end of the first phase compared to a single, rapid increase in temperature of the heating element at the start of the first phase. As such, gradually increasing the power to the heating element to gradually increase the temperature of the heating element may improve the efficiency of the heat transfer between the heating element and the aerosol-forming substrate, as less power may be supplied to the heating element during the first phase if the power is increased gradually.

As used herein, an 'aerosol-generating device' relates to a device that interacts with an aerosol-forming substrate to generate an aerosol. The aerosol-forming substrate may be solid or liquid, or a combination thereof. The aerosol-forming substrate may be part of an aerosol-generating article, for example part of a cartridge containing the aerosol-forming substrate or part of a stick comprising a body of aerosol-forming substrate and a filter wrapped together in the form of a rod, in a similar manner to a conventional cigarette. An aerosol-generating device may be a device that interacts with an aerosol-forming substrate of an aerosol-generating article to generate an aerosol that is directly inhalable into a user's lungs thorough the user's mouth.

As used herein, the term 'aerosol-forming substrate' is used to describe a substrate capable of releasing volatile compounds, which can form an aerosol.

The aerosol-forming substrate may be provided in a cartridge or container. The cartridge or container may be positioned proximate to the heating element. The heating element may heat the aerosol-forming substrate in the cartridge or container in both the first phase and the second phase.

As used herein, the term 'aerosol-generating article' refers to an article comprising an aerosol-forming substrate that is capable of releasing volatile compounds that can form an aerosol. For example, an aerosol-generating article may be an article that generates an aerosol that is directly inhalable into a user's lungs through the user's mouth. An aerosol-generating article may be disposable. An aerosol-generating article may be, or may comprise a cartridge containing the aerosol-forming substrate. An aerosol-generating article may be, or may comprise, a tobacco stick.

Where the aerosol-forming substrate is provided in an article, such as a cartridge, the rate of heat transfer between the heating element at a particular temperature and the aerosol-forming substrate contained in the article may vary depending on the article. Even for articles of the same design, variations during manufacture can result in variations in the rate of heat transfer.

Surprisingly, it has been found that the method of the first aspect of the invention may achieve smaller variations in the temperature profile of the aerosol-forming substrate during the first phase, compared to methods comprising a single, rapid increase in temperature of the heating element. This advantage may arise because a gradual increase in the temperature of the heating element over the first phase results in smaller temperature differences between the heater element, the article and the aerosol-forming substrate contained in the article during the first phase, compared to methods comprising a single, rapid increase in temperature of the heating element. The large temperature difference between the heater element, the article and the aerosol-forming substrate contained in the article that results after a single, rapid increase in temperature of the heating element may emphasise differences in the rate of heat transfer between different articles compared to the gradual increase in temperature of the heating element of the method of the first aspect of the invention.

In some embodiments, the temperature of the heating element may be measured and set directly, for example via a temperature setting means, such as a sensor, at or around the heater. In other embodiments, the temperature of the heating element may be measured and set indirectly, for example via measurement and setting of resistance of the heating element. The resistance of the heating element may depend on its temperature. As a result, the set temperature of the heating element may correspond to a specific resistance value of the heating element.

The relationship between the resistances and the temperatures of the heating element may be known. As such, it may be possible to determine the temperature of the heating element from a measurement of the electrical resistance of the heating element. In some embodiments, the determined relationship may be based on a number of reference values measured during a calibration of the heater, for example three reference values. For example, in an exemplary procedure to calibrate the heater, power may be supplied to the heating element and the temperature of the heating element may be measured. When the measured temperature of the heating element reaches a predetermined value that is to be used as a reference value, e.g. 150° C., 250° C. and 300° C., the resistance of the heating element is measured. The measured reference resistance values may be stored on a memory, such as a flash memory, in the aerosol-generating device. The device may further be configured to determine target resistance values for set temperatures different from the reference resistance values stored in the memory of the aerosol-generating device. For example, the device may be configured to interpolate or extrapolate additional reference resistance values from the stored reference resistance values. The interpolation or extrapolation may be based on a known relationship between temperature and resistance for the type of heating element used in the device. The relationship used for the interpolation or extrapolation typically depends on the material properties of the heating element, and therefore on the choice of the material of the heating element.

In operation, the device may be configured to enable a user to select a set temperature corresponding to a particular target temperature for the heating element. A set temperature may be reached and/or maintained as follows. For example, voltage may be provided to the heating element from the power supply in discrete pulses. The pulses may have a substantially constant magnitude. The pulses may have a duration of between 500 microseconds and 1 millisecond, for example 1 millisecond. After each pulse, the resistance of the heating element may be measured. The measured resistance may be compared to the stored or determined reference resistance value corresponding to the set temperature. If the resistance measurement indicates that the temperature of the heating element is below the set temperature, at least one of the number and duration of the pulses supplied to the heating element may be increased until the resistance reaches the set temperature. If the resistance measurement indicates that the temperature of the heating element is above the set temperature, at least one of the number and duration of pulses supplied to the heating element may be decreased or the pulses may be stopped until the resistance measurements indicate that the temperature of the heating element has dropped below the set temperature.

In some embodiments, the duration of the pulses may be variable. In other embodiments, the duration of the pulses may be constant. In some embodiments, the duration between pulses may be constant. In some embodiments, the duration between pulses may be variable. The minimum duration between the pulses may be such that a resistance measurement may be taken between the pulses. For example, the minimum duration between the pulses may be 100 microseconds. Measurements of resistance may be taken between pulses. Measurements of resistance may be taken e.g. every 1 millisecond. The time between the measurements may be any value between 1 millisecond and 100 microseconds, for example 300, 500 or 800 microseconds.

At least one of the duration of the pulses and the duration between the pulses may be variable. In other words, the power source may alter the duty cycle of the voltage supplied to the heating element in order to vary the supply of power to the heating element to achieve a particular resistance (temperature) of the heating element.

In some embodiments, the power (voltage) supplied to the heating element may be directly controlled by changing the temperature setting. In other embodiments, the power (voltage) supplied to the heating element may be indirectly controlled, for example, via a feedback loop that is updated using measured resistance values from the heating element.

The first and second temperatures may be set as described above. The first and second temperatures may be predetermined temperatures that are set in the factory and stored on a memory of the device.

The set temperatures may be set within an allowable temperature range. The allowable temperature range may a predetermined temperature range, verified by the manufacturer of the device and substrate, within which the components of the device and the substrate perform satisfactorily, without being overheated. The first temperature may be selected to be within an allowable temperature range, but may be selected close to a maximum allowable temperature of the range in order to generate a satisfactory amount of aerosol for initial delivery to the consumer. It may be desirable to achieve a relatively high temperature with the heating element during initial operation in order to promote vaporization of the substrate and generation of aerosol, as the delivery of aerosol may be diminished by condensation within the device during the initial period of device operation. This may be due to the average temperature of the device being lower during the initial period of operation compared to later periods of operation.

The first phase may be a pre-heating phase. As used herein, pre-heating phase refers to a phase in which the temperature of the aerosol-forming substrate is increased to reach a temperature at which a satisfactory amount of aerosol is produced. Aerosol may be generated in the first phase but typically may not be drawn from the device by the user. For example, by the end of the first (pre-heating) phase, a cartridge and a liquid aerosol-forming substrate contained therein may have reached the temperature of vaporization of the liquid. For example, by the end of the first (pre-heating) phase, a tobacco stick and the solid tobacco contained therein may have reached a temperature at which volatile components contained in the tobacco are released.

The first phase may have any suitable duration. The first phase may have a pre-determined duration. The first phase may have a duration of equal to or less than one minute. The duration of the first phase may be equal to or less than 45 seconds. The duration of the first phase may be about 30 seconds. If the duration of the first phase is about 30 seconds, a good balance between the speed of pre-heating and reduction of energy losses may be achieved.

During the first phase, power provided to the heating element may be progressively increased. The power provided to the heating element may be increased by altering the duty cycle of the power supplied to the heating element.

During the first phase, the power provided to the heating element may be progressively increased in steps or increments. For example, for a first period of time, a first power P1, corresponding to a first duty cycle, may be provided to the heating element to increase the temperature of the heating element; then, subsequently, for a second period of time, a second power P2, corresponding to a second duty cycle, may be provided to the heating element to further increase the temperature of the heating element, wherein the second power is greater than the first power (P2>P1). In this example, the first and second powers P1, P2 may be the average power over the duty cycle. The average power may be calculated in any suitable way, such as by using the RMS current and voltage provided to the heating element. In some embodiments, the power provided to the heating element may be altered by altering the magnitude of at least one of the voltage and the current supplied to the heating element.

In embodiments where the power is progressively increased in steps or increments, the first period of time and the second period of time together may be about 30 seconds. The first period of time and the second period of time may together be shorter than 30 seconds. In such case, a third power P3 may be provided, at the end of the second period of time, for a third period of time, wherein the third power is greater than the second power (P3>P2). The duration of the first, second and third periods of time together may be about 30 seconds. The duration of the first period of time may be up to 10 seconds. The duration of the first period of time may be about 5 seconds. The duration of the second period of time may be up to about 10 seconds. The duration of the second period of time may be about 5 seconds. The duration of the third period of time may be equal to or greater than 10 seconds. The duration of the third period of time may be about 20 seconds. The first, second and third periods of time may together be equal to or less than about 30 seconds.

Any suitable number of power increases may be performed in the first phase. For example, a fourth power P4 may be provided to the heating element at the end of third period of time for a fourth period of time, wherein the fourth power is greater than the third power (P4>P3) and a fifth power P5 may be provided to the heating element at the end of the fourth period of time for a fifth period of time, wherein the fifth power is greater than the fourth power (P5>P4).

In the first phase, each of the different powers (P1, P2, P3, etc.) supplied to the heating element may be supplied for a predetermined period of time. In some embodiments, the duration of each of the periods of time may be uniform. In other words, each of the steps or increments can be the same predetermined number of seconds long. For example, the duration of each of the periods of time may be about 5, 7, 10, 15 or 20 seconds long. In other embodiments, the duration of the periods of time may be non-uniform. For example, the first period of time can be shorter than the second period of time, the second period of time can be shorter than the third period of time, etc. For example, the first increase may take place after 5 seconds and the second increase after 5 seconds, with the power level set after the second increase maintained for 20 seconds. For example, with three increases of power, a first increase may take place after 5 seconds, a second increase after 10 seconds, with the power level after the second increase maintained for 15 seconds. A combination of uniform and non-uniform time periods is possible. For example, the first increase may take place after 5 seconds and the second increase after 5 seconds, with the power level set after the second increase maintained for 20 seconds. More or less than three steps are possible.

The increases in power may be uniform. In other words, each increase in power may have the same magnitude. The increases in power may correspond to uniform increases in set temperature. In other words, each increase in set temperature may have the same magnitude. The power provided may be a power expected to raise and maintain the heating element to a particular set temperature. For example, the increases in the set temperature may be by steps of between 10° C. and 100° C. For example, the increases may be in steps of 30° C., 50° C., 60° C., 80° C. However, it should be clear that the power may be further increased before the temperature of heating element has reaches a steady temperature.

The increases in power may be different or non-uniform. The increases in power may correspond to non-uniform increases in set temperature. For example, a first increase in temperature may be by a bigger step than a second, third etc. increases. For example, a first increase may correspond to about 80° C. and a second increase may correspond to about 50° C.

In the first phase, power provided to the heating element may gradually increase. For example, power provided to the heating element may increase the temperature of the heating element from ambient temperature to between 250° C. and 300° C., for example between 280° C. and 290° C., after 30 seconds. In some embodiments, the power may gradually increase in discrete steps or increments, as described above. However, in some embodiments, the increase in power supplied to the heating element in the first phase may be continuous. In this context, a continuous increase in power may mean that the duty cycle of the pulses is altered so that the average power over consecutive short periods of time, for example 1 millisecond or 10 milliseconds, is increasing. The increase in power provided to the heating element can be linear. In other words, the rate of increase of power over the first phase may be substantially constant. The increase in power provided to the heating element may be non-linear, for example proportional to an exponent of time that is greater than or less than 1, such as $\sim t^2$ or $\sim t^{1/2}$, where t is time. In other words, the rate of increase of power may vary with time.

In the first phase, power provided to the heating element may be dependent on a target temperature set by a controller.

For example, the controller may set a target temperature T1 and then provide power P1' to the heating element to heat and maintain the heating element to temperature T1. After pre-determined period of time t1, the controller may set a target temperature T2, which is higher than target temperature T1, and then provide power P2' to the heating element to heat and maintain the heating element to temperature T2. When temperature T2 is higher than temperature T1, power P2' is higher than P1'. Temperature T2 may be set and power P2' provided to the heating element even in case the heating element has not reached the temperature T1 after the pre-determined period of time t1. In an embodiment, the target temperature T2 can be set after the temperature T1 is reached, or after the pre-determined period of time t2, whichever occurs first. In an embodiment, the target temperature T2 can be set after the target temperature T1 is reached. In an embodiment, after a predetermined period of time t2, or after the temperature T2 is reached, a target temperature T3 may be set, which is higher than target temperature T2, and then provide power P3' to the heating element to heat the heating element to temperature T3. There may be e.g. three, five or ten steps.

For example, T1 may be 160° C. Power P1' is provided for t1=5 seconds. After 5 seconds, T2=240° C. is set, and power P2' is provided for t2=5 seconds. After 5 seconds, T3=290° C. is set and power P3' is provided for 20 seconds. After 30 seconds, the first phase terminates. In an embodiment, the next temperature may be set regardless of the previous temperature being reached.

When the first phase ends, the second phase begins and power to the heating element is controlled so as to reduce the temperature of the heating element to a second temperature that is lower than the first temperature. Where an allowable temperature range is defined, the second temperature is within the allowable temperature range. This reduction in temperature of the heating element in the second phase is typically desirable because after a period of heating the aerosol-generating device and the aerosol-forming substrate warm, condensation of aerosol in the device is generally reduced and the delivery of aerosol is generally increased for a given heating element temperature. In addition, reducing the heating element temperature reduces the amount of energy consumed by the aerosol-generating device. Moreover, varying the temperature of the heating element during operation of the device allows for a time-modulated thermal gradient to be introduced into the aerosol-forming substrate.

In the second phase, aerosol may be generated by the device at a satisfactory rate and may be inhaled by the user. As used herein, the terms 'puff' and 'inhalation' are used interchangeably and are intended to mean the action of a user drawing an aerosol into their body through their mouth or nose. Inhalation includes the situation where an aerosol is drawn into the user's lungs, and also the situation where an aerosol is only drawn into the user's mouth or nasal cavity before being expelled from the user's body.

In the second phase, the second temperature is lower than the first temperature. The second temperature may be higher than the initial temperature. The initial temperature may be ambient temperature, i.e. the temperature of the surroundings of the aerosol-generating device.

The second temperature may be higher than 100° C. The second temperature may be lower than 380° C. The second temperature may be between 140° C. and 200° C. The second temperature may be higher than 150° C. The second temperature may be between 150° C. and 190° C. The second temperature may be between 153° C. and 177° C. The second temperature may be about 177° C. With the second temperature in the range of 150° C. and 190° C., and more particularly between 153° C. and 177° C., the user acceptance with respect to taste may be enhanced.

The duration of the second phase may be at least 180 seconds. The duration of the second phase may be at least 240 seconds. The duration of the second phase may be at least 300 seconds. The duration of the second phase may be at least 360 seconds. The duration of the second phase may be about 360 seconds, which typically corresponds to user expectation for a user experience.

To reach the second temperature, power provided to the heating element drops from the value at the end of the first phase.

The second temperature may be maintained throughout the duration of the second phase. The second temperature is reached by controlling power provided to the heating element to drop the power below the power supplied to the heating element at the end of the first phase. The second temperature may then be maintained by controlling power provided to the heating element to keep the temperature of the heating element at the second temperature. For example, to maintain the second temperature, constant average power may be supplied to the heating element during the second phase. For example, to maintain the second temperature, power pulses at a constant duty cycle may be supplied to the heating element.

As an example, the second temperature may be reached as follows. The target temperature is set to the second temperature. The resistance measurement made by the device indicates that the temperature of the heating element is above the target temperature. The power source stops providing voltage pulses to the heating element and the aerosol-generating device monitors the resistance (and thus the temperature) of the heating element until the temperature drops below the target temperature. At this point, the power source begins to supply voltage pulses to the heating element again to reach the second temperature. The second temperature may subsequently be maintained in an analogous process.

During the second phase, the second temperature may be maintained for a predetermined period of time shorter than the duration of the second phase. Power provided to the heating element may then be lowered, so that the temperature of the heating element drops to a third temperature. The third temperature is lower than the second temperature.

The second temperature may be maintained for any suitable predetermined period of time. The second temperature may be maintained for between about 30-120 seconds. The second temperature may be maintained for between about 45-90 seconds. The second temperature may be maintained for about 60 seconds. The third temperature may be maintained for the rest of the duration of the second phase. Depending on the duration of the second phase, the third temperature may be maintained for 120 seconds; for 180 seconds; for 240 seconds; or for 300 seconds.

The third temperature may be lower than the second temperature. The third temperature may be higher than the initial temperature. The third temperature may be higher than 100° C. The third temperature may be higher than 160° C. The third temperature may be 165° C.

The second and third temperatures may be chosen such that aerosol is generated continuously during the second phase. The second and third temperatures are preferably determined based on range of temperatures that correspond to the vaporization temperature of the aerosol-forming substrate. Power may be provided to the heating element during the second phase to ensure that the temperature does not fall below a minimum allowable temperature.

In an exemplary embodiment, the second set temperature may be about 177° C., and the third set temperature may be about 165° C. The second set temperature may be maintained for about 60 seconds, and the third set temperature may be maintained for about 300 seconds.

The step of controlling power provided to the heating element is advantageously performed so as to maintain the temperature of the heating element within the allowable or desired temperature range in the second phase.

The step of controlling the power to the heating element may comprise measuring a temperature of the heating element or a temperature proximate to the heating element to provide a measured temperature, performing a comparison of the measured temperature to a target temperature, and adjusting the power provided to the heating element based a result of the comparison. The target temperature preferably changes with time following activation of the device to provide the first and second phases. It should be clear that the target temperature may be chosen to have any desired temporal profile within the constraints of the first and second phases of operation.

The method may further comprise the step of identifying a characteristic of the aerosol-forming substrate. The step of controlling the power may then be adjusted dependent on the identified characteristic. For example, different target temperatures may be used for different substrates.

The aerosol-forming substrate may be a liquid aerosol-forming substrate. If a liquid aerosol-forming substrate is provided, the aerosol-generating device preferably comprises means for retaining the liquid. For example, the liquid aerosol-forming substrate may be retained in a container.

In some embodiments, the aerosol-generating device may comprise at least one compartment which contains the aerosol-forming substrate. The device may comprise at least two compartments. The device may comprise a first compartment containing a first component of an aerosol-forming substrate and a second compartment comprising a second component of an aerosol-forming substrate. The device may comprise a first compartment containing a nicotine source and a second compartment comprising an acid source for generating an aerosol nicotine salt particles.

In some embodiments, the liquid aerosol-forming substrate may be absorbed into a porous carrier material. The porous carrier material may be made from any suitable absorbent plug or body, for example, a foamed metal or plastics material, polypropylene, terylene, nylon fibres or ceramic. The liquid aerosol-forming substrate may be retained in the porous carrier material prior to use of the aerosol-generating device. The liquid aerosol-forming substrate material may be released into the porous carrier material during, or immediately prior to use. For example, the liquid aerosol-forming substrate may be provided in a capsule. The shell of the capsule may melt upon heating, releasing the liquid aerosol-forming substrate into the porous carrier material. The capsule may optionally contain a solid in combination with the liquid.

The carrier may be a non-woven fabric or fibre bundle into which tobacco components have been incorporated. The non-woven fabric or fibre bundle may comprise, for example, carbon fibres, natural cellulose fibres, or cellulose derivative fibres.

In some embodiments, the aerosol-forming substrate may comprise nicotine source and acid source for use in an aerosol-generating system for the in situ generation of an aerosol comprising nicotine salt particles. In such embodiments, the nicotine source may comprise a first carrier material impregnated with between about 1 milligram and about 50 milligrams of nicotine. The nicotine source may comprise a first carrier material impregnated with between about 1 milligram and about 40 milligrams of nicotine. The nicotine source may comprise a first carrier material impregnated with between about 3 milligrams and about 30 milligrams of nicotine. The nicotine source may comprise a first carrier material impregnated with between about 6 milligrams and about 20 milligrams of nicotine. The nicotine source may comprise a first carrier material impregnated with between about 8 milligrams and about 18 milligrams of nicotine.

The first carrier material may be impregnated with liquid nicotine or a solution of nicotine in an aqueous or non-aqueous solvent. The first carrier material may be impregnated with natural nicotine or synthetic nicotine.

In such embodiments, the acid source may comprise an organic acid or an inorganic acid. The acid source may comprise an organic acid, e.g. a carboxylic acid. The acid source may comprise e.g. an alpha-keto or 2-oxo acid or lactic acid. The acid source may comprise an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid, lactic acid and combinations thereof. The acid source may comprise pyruvic acid or lactic acid. The acid source may comprise lactic acid.

The acid source may comprise a second carrier material impregnated with acid.

The first carrier material and the second carrier material may be the same or different. The first carrier material and the second carrier material may have a density of between about 0.1 grams/cubic centimetre and about 0.3 grams/cubic centimetre. The first carrier material and the second carrier material may have a porosity of between about 15 percent and about 55 percent. The first carrier material and the second carrier material may comprise one or more of glass, cellulose, ceramic, stainless steel, aluminium, polyethylene (PE), polypropylene, polyethylene terephthalate (PET), poly (cyclohexanedimethylene terephthalate) (PCT), polybutylene terephthalate (PBT), polytetrafluoroethylene (PTFE), expanded polytetrafluoroethylene (ePTFE), and BAREX®.

The first carrier material acts as a reservoir for the nicotine. The first carrier material may be chemically inert with respect to nicotine.

The first carrier material may have any suitable shape and size. For example, the first carrier material may be in the form of a sheet or plug. The shape and size of the first carrier material may be similar to the shape and size of the first compartment. The shape, size, density and porosity of the first carrier material may be chosen to allow the first carrier material to be impregnated with a desired amount of nicotine.

The first compartment may further comprise a flavourant. Suitable flavourants include, but are not limited to, menthol.

The first carrier material may be impregnated with between about 3 milligrams and about 12 milligrams of flavourant.

The second carrier material acts as a reservoir for the acid. The second carrier material may be chemically inert with respect to the acid. The second carrier material may have any suitable shape and size. For example, the second carrier material may be in the form of a sheet or plug. The shape and size of the second carrier material may be similar to the shape and size of the second compartment. The shape, size, density and porosity of the second carrier material may be chosen to allow the second carrier material to be impregnated with a desired amount of acid.

The acid source may be a lactic acid source comprising a second carrier material impregnated with between about 2 milligrams and about 60 milligrams of lactic acid. The lactic acid source may comprise a second carrier material impregnated with between about 5 milligrams and about 50 milligrams of lactic acid. The lactic acid source may comprise a second carrier material impregnated with between about 8 milligrams and about 40 milligrams of lactic acid. The lactic acid source may comprise a second carrier material impregnated with between about 10 milligrams and about 30 milligrams of lactic acid.

The shape and dimensions of the first compartment may be chosen to allow a desired amount of nicotine to be housed in the device. The shape and dimensions of the second compartment may be chosen to allow a desired amount of acid to be housed in the device. The ratio of nicotine and acid required to achieve an appropriate reaction stoichiometry may be controlled and balanced through variation of the volume of the first compartment relative to the volume of the second compartment.

In some embodiments, the aerosol-forming substrate may be a solid aerosol-forming substrate. The aerosol-forming substrate may comprise both solid and liquid components. The aerosol-forming substrate may comprise only liquid components. The aerosol-forming substrate may comprise one or more liquid components. In some embodiments, the aerosol-forming substrate may comprise a tobacco-containing material containing volatile tobacco flavour compounds which are released from the substrate upon heating. In some embodiments, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate. As used herein, homogenised tobacco refers to material formed by agglomerating particulate tobacco. Homogenised tobacco may be in the form of a sheet.

The aerosols generated from aerosol-forming substrates may be visible or invisible and may include vapours (for example, fine particles of substances, which are in a gaseous state, that are ordinarily liquid or solid at room temperature) as well as gases and liquid droplets of condensed vapours.

The heating element may be an electric heating element.

The aerosol-generating device may comprise any suitable heating element. The aerosol-generating device may comprise a resistive heater, an inductive heater, or a combination of both.

In some embodiments, the heating element may be elongate. The heating element may be surrounded by a thermally conductive sheath. The thermally conductive sheath may be adapted to be inserted into the aerosol-generating article, such as into a portion of a cartridge. The thermally conductive sheath may be adapted to be inserted into the aerosol-forming substrate. Advantageously, the thermally conductive sheath may be provided to evenly distribute the heat provided by the one or more heating elements.

The heating element may be an electrically resistive heating element and the step of controlling the power provided to the heating element may comprise determining the electrical resistance of the heating element and adjusting the electrical current supplied to the heating element dependent on the determined electrical resistance. The electrical resistance of the heating element may be indicative of the temperature of the heating element and so the determined electrical resistance may be compared with a target electrical resistance and the power provided may be adjusted accordingly. A PID control loop may be used to bring the determined temperature to a target temperature. Furthermore, mechanisms for temperature sensing other than detecting the electrical resistance of the heating element may be used, such as bimetallic strips, thermocouples or a dedicated thermistor or electrically resistive element that is electrically separate to the heating element. These temperature sensing mechanisms may be used in addition to or instead of determining temperature by monitoring the electrical resistance of the heating element. For example, a separate temperature sensing mechanism may be used in a control mechanism for cutting power to the heating element when the temperature of the heating element exceeds the allowable temperature range.

The aerosol-generating device may comprise a cartridge. The cartridge may comprise at least one compartment which contains the aerosol-forming substrate. The cartridge may comprise at least two compartments. The cartridge may comprise a first compartment containing a first component of an aerosol-forming substrate and a second compartment comprising a second component of an aerosol-forming substrate. The cartridge may comprise a first compartment containing a nicotine source and a second compartment comprising a lactic acid source for generating an aerosol comprising nicotine lactate salt particles.

The cartridge may have any suitable shape. The cartridge may be substantially cylindrical. The cartridge may have any suitable size. The cartridge may have a length of, for example, between about 5 mm and about 30 mm. In certain embodiments the cartridge may have a length of about 20 mm. The cartridge may have a diameter of, for example, between about 4 mm and about 10 mm. In certain embodiments the cartridge may have a diameter of about 7 mm.

The cartridge may comprise a first compartment comprising the nicotine source and a second compartment comprising the lactic acid source.

The cartridge may be formed from one or more suitable materials. Suitable materials include, but are not limited to, aluminium, polyether ether ketone (PEEK), polyimides, such as Kapton®, polyethylene terephthalate (PET), polyethylene (PE), polypropylene (PP), polystyrene (PS), fluorinated ethylene propylene (FEP), polytetrafluoroethylene (PTFE), epoxy resins, polyurethane resins and vinyl resins.

The cartridge may be formed from one or more materials that are nicotine-resistant and lactic acid-resistant. The first compartment comprising the nicotine source may be coated with one or more nicotine-resistant materials and the second compartment comprising the lactic acid source may be coated with one or more lactic acid-resistant materials. Examples of suitable nicotine-resistant materials and lactic acid-resistant materials include, but are not limited to, polyethylene (PE), polypropylene (PP), polystyrene (PS), fluorinated ethylene propylene (FEP), polytetrafluoroethylene (PTFE), epoxy resins, polyurethane resins, vinyl resins and combinations thereof. Use of one or more nicotine-resistant materials and lactic acid-resistant materials to form the cartridge or coat the interior of the first compartment and the second compartment, respectively, may enhance the shelf life of the aerosol-generating article.

The cartridge may be formed from one or more thermally conductive materials. The interior of the first compartment and the second compartment may be coated with one or more thermally conductive materials. Use of one or more thermally conductive materials to form the cartridge or coat the interior of the first compartment and the second compartment may increase heat transfer from the heater to the nicotine source and lactic acid source.

Suitable thermally conductive materials include, but are not limited to, metals such as, for example, aluminium, chromium, copper, gold, iron, nickel and silver, alloys, such as brass and steel and combinations thereof.

Cartridges for use in aerosol-generating systems according to the present invention and aerosol-generating articles according to the present invention may be formed by any suitable method. Suitable methods include, but are not limited to, deep drawing, injection moulding, blistering, blow forming and extrusion.

The first compartment and the second compartment may be arranged in parallel within the cartridge.

The cartridge may further comprise a third compartment comprising an aerosol-modifying agent. In such embodiments the first compartment, the second compartment and the third compartment may be arranged in parallel within the cartridge.

In some embodiments, the cartridge is substantially cylindrical. The first compartment, the second compartment and, where present, the third compartment may extend longitudinally between opposing substantially planar end faces of the cartridge.

The cartridge may further comprise a cavity for receiving a heating element of the device. The cavity may be arranged between the first and second compartments. The aerosol-generating device may comprise a single heating element configured to be received in the cavity.

In certain embodiments, the aerosol-generating device comprises: a body portion comprising a single heating element; and a mouthpiece portion configured for engagement with the body portion, wherein the aerosol-generating device is configured to receive an aerosol-generating article comprising a cartridge comprising a first compartment comprising a nicotine source, a second compartment comprising a lactic acid source and a cavity such that the single heating element of the body portion is received in the cavity.

The aerosol-generating article may be received entirely within the body portion of the aerosol-generating device or entirely within the mouthpiece portion of the aerosol-generating device or partially within the body portion of the aerosol-generating device and partially within the mouthpiece portion of the aerosol-generating device.

The aerosol-generating device may further comprise a guide portion configured for engagement with the body portion to facilitate proper alignment of the single heating element with the cavity in the cartridge of the aerosol-generating article.

In certain embodiments, the single heating element is an internal electric heating element configured to be received in the cavity of the cartridge of the aerosol-generating article. In certain embodiments, the single heating element is an elongate internal electric heating element in the form of a heater blade configured to be received in the cavity of the cartridge of the aerosol-generating article. In such embodiments, the cavity in the cartridge of the aerosol-generated article may be configured as an elongate slot.

In embodiments in which the cartridge is substantially cylindrical, the cavity in the cartridge may extend along the longitudinal axis of the cartridge between the opposed substantially planar end faces of the cartridge. In such embodiments the first compartment, the second compartment and, where present, the third compartment may be disposed around the cavity in the cartridge.

The first compartment may consist of one or more first chambers within the cartridge. The number and dimensions of the one or more first chambers may be chosen to allow a desired amount of nicotine to be included in the cartridge.

The second compartment may consist of one or more second chambers within the cartridge. The number and dimensions of the one or more second chambers may be chosen to allow a desired amount of lactic acid to be included in the cartridge.

The cartridge may comprise a cavity into which a heating element is inserted. The cavity may be provided in the central part of the cartridge and surrounded by the compartment or compartments containing the aerosol-forming substrate.

The cartridge may comprise one or more liquid components which, upon vaporization, form the aerosol which is inhaled by a user. The heating element may be provided to heat the liquids above the vaporization temperature.

The cartridge may be removable from the aerosol-generating device. As the cartridge has a limited volume (containing a limited amount of the aerosol-forming substrate), the cartridge may be removable and exchangeable. For example, the cartridge can be single-use only. In such case the cartridge is removed and disposed of after each session.

In a second aspect of the invention, there is provided an electrically operated aerosol-generating device, the device comprising: at least one heating element configured to heat an aerosol-forming substrate to generate an aerosol; a power supply for supplying power to the heating element; and electric circuitry for controlling supply of power from the power supply to the at least one heating element, wherein the electric circuitry is arranged to:

control the power provided to the heating element such that in a first phase power is provided to increase the temperature of the heating element from an initial temperature to a first temperature, and in a second phase power is provided to decrease the temperature of the heating element below the first temperature to a second temperature, wherein the power provided to the heating element during the first phase is increased at least once during the duration of the first phase; and wherein the power provided to the heating element during the first phase does not decrease during the first phase.

The duration of each of the phases and the temperature of the heating element during each of the phases may be as described in relation to the first aspect.

The electric circuitry may be configured such that the first phase has a fixed duration. The electric circuitry may be further configured such that the second phase has a fixed duration. The electric circuitry may be configured to control the power provided to the heating element so as to maintain the second and/or the third temperature of the heating element during the third phase.

In some embodiments, the circuitry may be arranged to provide power to the heating element by supplying voltage from the power supply to the heating element in discrete pulses. The power provided to the heating element may then be adjusted by adjusting the duty cycle of the voltage supply. The duty cycle may be adjusted by any suitable means, such as by altering the pulse width, or the frequency of the pulses or both. In some embodiments, the circuitry may be arranged to provide power to the heating element as a continuous DC signal.

The electric circuitry may comprise a temperature sensing means configured to measure a temperature of the heating element or a temperature proximate to the heating element to provide a measured temperature, and may be configured to perform a comparison of the measured temperature to a target temperature, and adjust the power provided to the heating element based a result of the comparison. The target temperature may be stored in an electronic memory and preferably changes with time following activation of the device to provide the first and second phases.

The temperature sensing means may be a dedicated electric component, such as a thermistor, or may be circuitry configured to determine temperature based on an electrical resistance of the heating element.

The electric circuitry may further comprise a means for identifying a characteristic of an aerosol-forming substrate in the device and a memory holding a look-up table of power control instructions and corresponding aerosol-forming substrate characteristics.

In both the first and second aspects of the invention, the heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

In both the first and second aspects of the invention, the aerosol-generating device may comprise an internal heating element or an external heating element, or both internal and external heating elements, where "internal" and "external" refer to the aerosol-forming substrate. An internal heating element may take any suitable form. For example, an internal heating element may take the form of a heating blade. The internal heater may take the form of a casing or substrate having different electro-conductive portions, or an electrically resistive metallic tube. The internal heating element may be one or more heating needles or rods that run through the centre of the aerosol-forming substrate. The internal heating element may comprise a heating wire or filament, for example a Ni—Cr (Nickel-Chromium), platinum, tungsten or alloy wire or a heating plate. Optionally, the internal heating element may be deposited in or on a rigid carrier material. In one such embodiment, the electrically resistive heating element may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heating elements during operation.

An external heating element may take any suitable form. For example, an external heating element may take the form of one or more flexible heating foils on a dielectric substrate, such as polyimide. The flexible heating foils can be shaped to conform to the perimeter of the substrate receiving cavity. An external heating element may take the form of a metallic grid or grids, a flexible printed circuit board, a moulded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

The internal or external heating element may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. In one embodiment, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy. In some embodiments, the heat sink or heat reservoir may be arranged such that it is directly in contact with the aerosol-forming substrate and can transfer the stored heat directly to the substrate. In some embodiments, the heat stored in the heat sink or heat reservoir may be transferred to the aerosol-forming substrate by means of a heat conductor, such as a metallic tube.

The heating element may heat the aerosol-forming substrate by means of conduction. The heating element may be at least partially in contact with the substrate, or the carrier on which the substrate is deposited. In some embodiments, the heat from either an internal or external heating element may be conducted to the substrate by means of a heat conductive element.

In both the first and second aspects of the invention, during operation, the aerosol-forming substrate may be completely contained within the aerosol-generating device. In that case, a user may puff on a mouthpiece of the aerosol-generating device. In some embodiments an aerosol-generating article containing the aerosol-forming substrate may be partially contained within the aerosol-generating device during operation. In that case, the user may puff directly on the aerosol-generating article aerosol-generating article. The heating element may be positioned within a cavity in the device, wherein the cavity is configured to receive an aerosol-forming substrate such that in use the heating element is within the aerosol-forming substrate.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The aerosol-generating article may have a total length between approximately 30 mm and approximately 100 mm. The aerosol-generating article may have an external diameter between approximately 5 mm and approximately 12 mm. The aerosol-generating article may comprise a filter plug. The filter plug may be located at the downstream end of the aerosol-generating article. The filter plug may be a cellulose acetate filter plug. The filter plug is approximately 7 mm in length in one embodiment, but may have a length of between approximately 5 mm to approximately 10 mm.

In one embodiment, the aerosol-generating article has a total length of approximately 45 mm. The aerosol-generating article may have an external diameter of approximately 7.2 mm. Further, the aerosol-forming substrate may have a length of approximately 10 mm. The aerosol-forming substrate may have a length of approximately 12 mm. Further, the diameter of the aerosol-forming substrate may be between approximately 5 mm and approximately 12 mm. The aerosol-generating article may comprise an outer paper wrapper. Further, the aerosol-generating article may comprise a separation between the aerosol-forming substrate and the filter plug. The separation may be approximately 18 mm, but may be in the range of approximately 5 mm to approximately 25 mm. The separation is preferably filled in the aerosol-generating article by a heat exchanger that cools the aerosol as it passes through the aerosol-generating article from the substrate to the filter plug. The heat exchanger may be, for example, a polymer based filter, for example a crimped PLA material.

In both the first and second aspects of the invention, the aerosol-generating device may further comprise a power supply for supplying power to the heating element. The power supply may be any suitable power supply, for example a DC voltage source. In one embodiment, the power supply is a Lithium-ion battery. The power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery. In some embodiments, the power supply may include one or more capacitors, super capacitors or hybrid capacitors.

In a third aspect of the invention, there is provided electric circuitry for an electrically operated aerosol-generating device, the electric circuitry being arranged to perform the method of the first aspect of the invention.

In a fourth aspect of the invention, there is provided a computer program which, when run on programmable electric circuitry for an electrically operated aerosol-generating device, causes the programmable electric circuitry to perform the method of the first aspect of the invention.

In a fifth aspect of the invention, there is provided a computer readable storage medium having stored thereon a computer program according to the fourth aspect of the invention.

In a sixth aspect of the invention, there is provided a system comprising a device according to the second aspect of the invention, and a cartridge containing an aerosol-forming substrate. The cartridge may comprise a liquid nicotine source and a liquid acid source. The cartridge may be as described above in relation to the first aspect of the invention.

In a seventh aspect of the invention, there is provided a method of controlling an electrical heating element in an aerosol-generating device, the device comprising a heater comprising at least one heating element configured to heat an aerosol-forming substrate and a power source for providing power to the heating element, the method comprising controlling the power provided to the heating element in a preheating mode, the preheating mode comprising providing power to the heating element to increase the temperature of the heating element from an initial temperature to a preheating target temperature, wherein the power provided in the preheating mode to the heater is increased according to a predetermined power profile.

The method may further comprise providing power to the heating element in an operating mode, subsequent to the preheating mode. The operating mode may comprise providing power to the heating element to maintain the temperature of the heating element substantially at an operating temperature.

The preheating target temperature may be greater than the operating temperature.

The predetermined power profile may comprise increasing the power provided to the heating element at a predetermined rate. The predetermined rate may be substantially constant. In other words, the power may increase substantially linearly over time in the preheating mode.

The predetermined power profile may comprise increasing the power provided to the heating element in one or more steps.

The predetermined power profile may comprise:

in a first step, providing power to the heating element to increase the temperature of the heating element from an initial temperature to a first target temperature; and in a second step, providing power to the heating element to increase the temperature of the heating element from the first target temperature to the preheating target temperature.

The power provided to the heater in the preheating mode may be increased by increasing the average power provided to the heater. Increasing the average power provided to the heater may be achieved by altering the duty cycle of the power supplied to the heater in an appropriate manner. The average power may be increased by altering the magnitude of the voltage or current supplied to the heater.

The predetermined power profile may be increased as described in connection with the first aspect of the invention.

The aerosol-forming substrate may be provided in a cartridge. The cartridge may be positioned proximate to the heating element. The heating element may heat the aerosol-forming substrate in the cartridge in both the preheating mode and the operating mode.

The features of the first aspect of the invention, described in detail above, may be combined with the features of the fifth aspect of the invention and vice versa. More generally, although the disclosure has been described by reference to different aspects, it should be clear that features described in relation to one aspect of the disclosure may be applied to the other aspects of the disclosure.

FIG. 1 shows a schematic illustration of an aerosol-generating system 10 according to the invention for generating an aerosol comprising nicotine lactate salt particles. The aerosol-generating system 10 comprises an aerosol-generating device 100, a cartridge assembly 200, and a mouthpiece 300.

Figure 2:
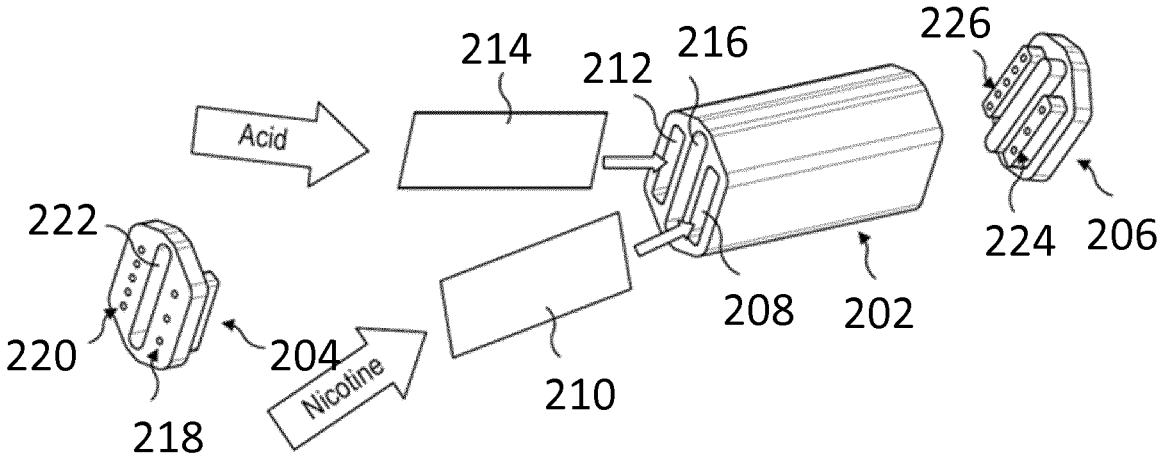
FIG. 2 shows a cartridge for use in the aerosol-generating system of FIG. 1.

FIG. 2 shows a schematic illustration of a cartridge assembly 200 for use in the aerosol-generating system of FIG. 1. The cartridge 200 comprises an elongate body 202, a distal end cap 204 and a proximal end cap 206.

The cartridge 200 comprises an elongate first compartment 208 that extends from the proximal end of the body 202 to the distal end of the body 202. The first compartment 208 contains a nicotine source comprising a first carrier material 210 impregnated with about nicotine and menthol.

The cartridge 200 also comprises an elongate second compartment 212 that extends from the proximal end of the body 202 to the distal end of the body 202. The second compartment 212 contains a lactic acid source comprising a second carrier material 214 impregnated with lactic acid.

The first compartment 208 and the second compartment 212 are arranged in parallel.

The cartridge 200 further comprises a heater cavity 216 for receiving an electric heater of the aerosol-generating device, which is configured to heat the first compartment 208 and the second compartment 212. The cavity 216 is located between the first compartment 208 and the second compartment 212 and extends from the proximal end of the body 202 to the distal end of the body 202. The cavity 216 is of substantially stadium shaped transverse cross-section.

The distal end cap 204 comprises a first air inlet 218 comprising a row of three spaced apart apertures and a second air inlet 220 comprising a row of five spaced apart apertures. Each of the apertures forming the first air inlet 218 and the second air inlet 220 is of substantially circular transverse cross-section. The distal end cap 204 further comprises a third inlet 222 located between the first air inlet 218 and the second air inlet 220. The third inlet 222 is also of substantially stadium shaped transverse cross-section.

The proximal end cap 206 comprises a first air outlet 224 comprising a row of three spaced apart apertures and a second air outlet 226 comprising a row of five spaced apart apertures. Each of the apertures forming the first air outlet 224 and the second air outlet 226 is of substantially circular transverse cross-section.

To form the cartridge 200, the proximal end cap 206 is inserted into the proximal end of the body 202 such that the first air outlet 224 is aligned with the first compartment 208 and the second air outlet 226 is aligned with the second compartment 212. The first carrier material 210 impregnated with nicotine and menthol is inserted into the first compartment 208 and the second carrier material 214 impregnated with lactic acid is inserted into the second compartment 212. The distal end cap 204 is then inserted into the distal end of the body 202 such that the first air inlet 218 is aligned with the first compartment 208, the second air inlet 220 is aligned with the second compartment 212 and the third inlet 222 is aligned with the heater cavity 216.

The first compartment 208 and the second compartment 212 are substantially the same shape and size. The first compartment 208 and the second compartment 212 are of substantially rectangular transverse cross-section and have a length of about 11 millimetres, a width of about 4.3 millimetres and a height of about 1 millimetres. The first carrier material 210 and the second carrier material 214 comprise a non-woven sheet of PET/PBT and are substantially the same shape and size. The shape and size of the first carrier material 210 and the second carrier material 214 is similar to the shape and size of the first compartment 208 and the second compartment 212 of the cartridge 2, respectively.

The first air inlet 218 is in fluid communication with the first air outlet 224 so that a first air stream may pass into the cartridge 200 through the first air inlet 218, through the first compartment 208 and out of the cartridge 200 though the first air outlet 224. The second air inlet 220 is in fluid communication with the second air outlet 226 so that a second air stream may pass into the cartridge 200 through the second air inlet 220, through the second compartment 212 and out of the cartridge 2 though the second air outlet 226.

Prior to first use of the cartridge 200, the first air inlet 218 and the second air inlet 220 may be sealed by a removable peel-off foil seal or a pierceable foil seal (not shown) applied to the external face of the distal end cap 204. Similarly, prior to first use of the cartridge 200, the first air outlet 224 and the second air outlet 226 may be sealed by a removable peel-off foil seal or a pierceable foil seal (not shown) applied to the external face of the proximal end cap 206.

Figure 3:
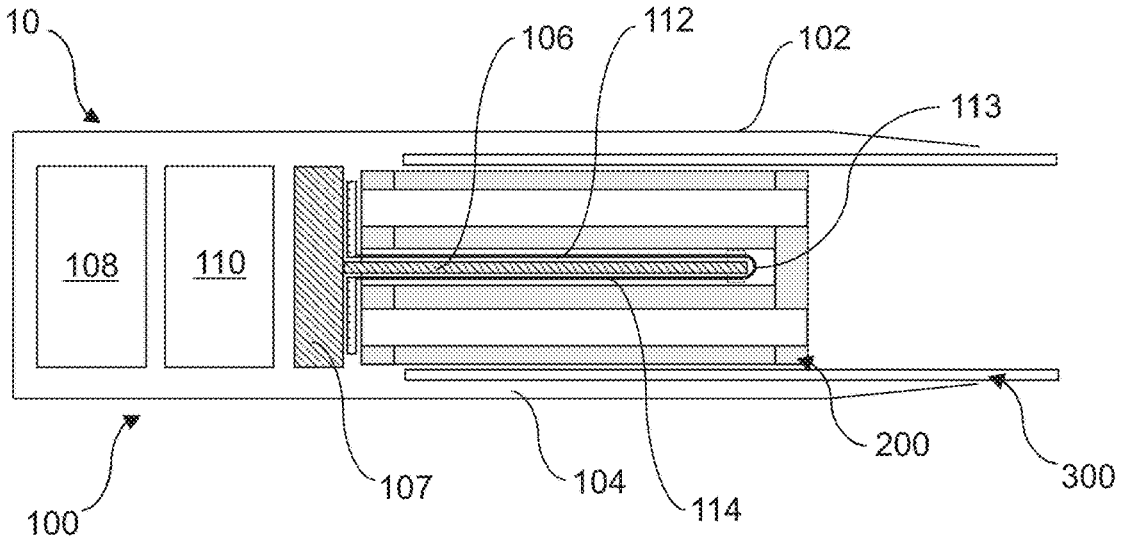
FIG. 3 shows a longitudinal cross-section of the aerosol-generating system of FIG. 1 with the cartridge of FIG. 2 received in the aerosol-generating device.

FIG. 3 schematically illustrates a longitudinal cross-section of the aerosol-generating system 10 of FIG. 1 with the cartridge 200 received in the aerosol-generating device 100. As shown in FIG. 3, the aerosol-generating device 100 comprises a device housing 102 defining a device cavity 104 for receiving the cartridge 200 and an upstream portion of the mouthpiece 300 which is engaged with the cartridge 200. The aerosol-generating device 100 further comprises an elongate electric heater 106 extending from a base portion 107, an electrical power supply 108, and a controller 110 for controlling a supply of electrical power from the electrical power supply 108 to the electric heater 106 via electrical contacts (not shown) on the base portion 107. The electric heater 106 is positioned centrally in the device cavity 104 and extends from the base portion 107 along the major axis of the device cavity 104. The electric heater 106 comprises an electrically insulating substrate and a resistive heating element positioned on the electrically insulating substrate. Positioned over the electric heater 106 is thermally conductive sheath 112 which forms a protective cover for the electric heater 106 and acts as a thermal bridge between the electric heater 106 and the cartridge 200 during use. In another embodiment (not shown), the distal end of the mouthpiece 300 may be configured for engagement with the proximal end of the housing 102 of the aerosol-generating device 100 rather than the cartridge 200.

In use, the controller 110 controls a supply of electrical power from the electrical power supply 108 to the electric heater 106 to generate heat in the heating element which is then transferred to the cartridge 200 via the sheath 112 to heat the first compartment 208 and the second compartment 212 to an operating temperature of between 85° C. and 115° C. The thermally conductive sheath spreads heat from the electric heater across its outer surface to ensure more homogenous heating of the cartridge relative to arrangements in which no sheath is present. When the device is activated, a preheat profile is applied to heat the heating element to bring the cartridge up to the operating temperature as quickly as possible.

When a user draws on the proximal end of the mouthpiece 300, air is drawn through the aerosol-generating system 10 through system airflow inlets extending through the housing 102 of the aerosol-generating device 100. The air is directed to the upstream end of the device cavity 104 where a first air stream is drawn through the first compartment 208 of the cartridge 200 and a second air stream is drawn through the second compartment 212 of the cartridge 200. As the first air stream is drawn through the first compartment 208, nicotine vapour is released from the first carrier material 210 into the first air stream. As the second air stream is drawn through the second compartment 212, lactic acid vapour is released from the second carrier material 214 into the second air stream. The nicotine vapour in the first air stream and the lactic acid vapour in the second air stream react with one another in the gas phase in the mouthpiece 300 to form an aerosol of nicotine salt particles, which is delivered to the user through the proximal end of the mouthpiece 300.

The sheath 112 is formed from a flat metal sheet which is wider than the electric heater 106 and which has been bent into a U-shape along a bend line 113 such that the sheath 112 comprises two opposed sheath walls 114. The sheath 112 is provided with a sheath mount (not shown) at its distal end by which the sheath 112 may be held in position over the electric heater 106.

Figure 5:
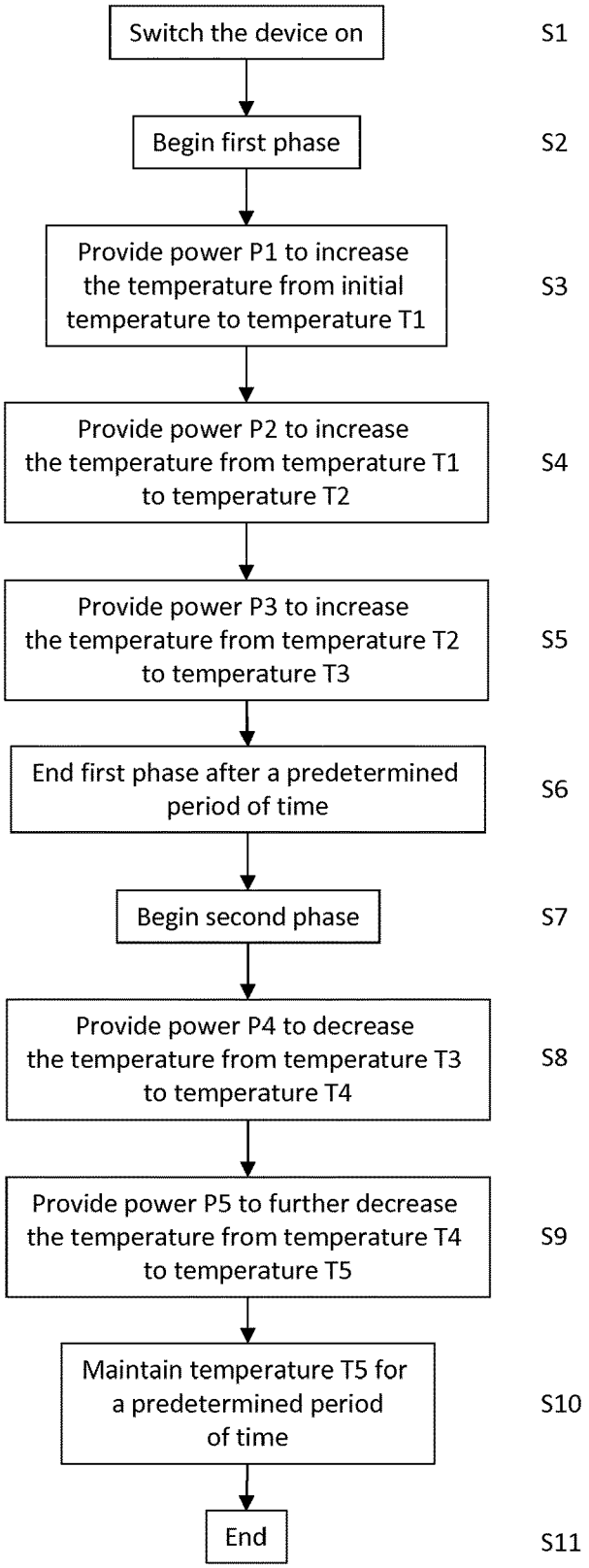
FIG. 5 is a flow diagram illustrating a preheating mode of operation in accordance with the invention.

An example heating process is illustrated by FIG. 5. After the device is switched on (step S1), the first phase (preheating phase) begins (step S2). Throughout the first phase, the controller is configured to control the supply of power from the power supply to the heater to raise or lower the temperature of the heater to a set of target temperatures. Initially, the heater is set to a first target temperature of T1=160° C. (step S3), and appropriate power P1 is provided to the heater for 5 seconds. After 5 seconds, regardless of whether the heater has reached the target temperature T1, the heater is set to a second target temperature of T2=240° C. (step S4), and appropriate power P2 is provided to the heater for 5 seconds. After 5 seconds, regardless of whether the heater has reached the second target temperature of T2, the heater is set to a third target temperature of T3=290° C. (step S5), and appropriate power P3 is provided to the heater for 20 seconds. After 20 seconds, regardless of whether the heater has reached the third target temperature, the first (preheating) phase ends (step S6). As such, the first (preheating) phase lasts for the predetermined period of time of 30 seconds. After the first (preheating) phase ends, the second phase (the aerosol generating phase) begins (step S7). The heater is set to a target temperature of T4=177° C. (step S8), and appropriate power P4 is provided to the heater for 60 seconds. After 60 seconds, the heater is set to a target temperature of T5=165° C., and appropriate power P5 is provided to the heater for 300 seconds (steps S9, S10). After 300 seconds, the second phase ends (step S11). As such, the second (aerosol-generating) phase lasts for a maximum predetermined period of time of 360 seconds.

Figure 4:
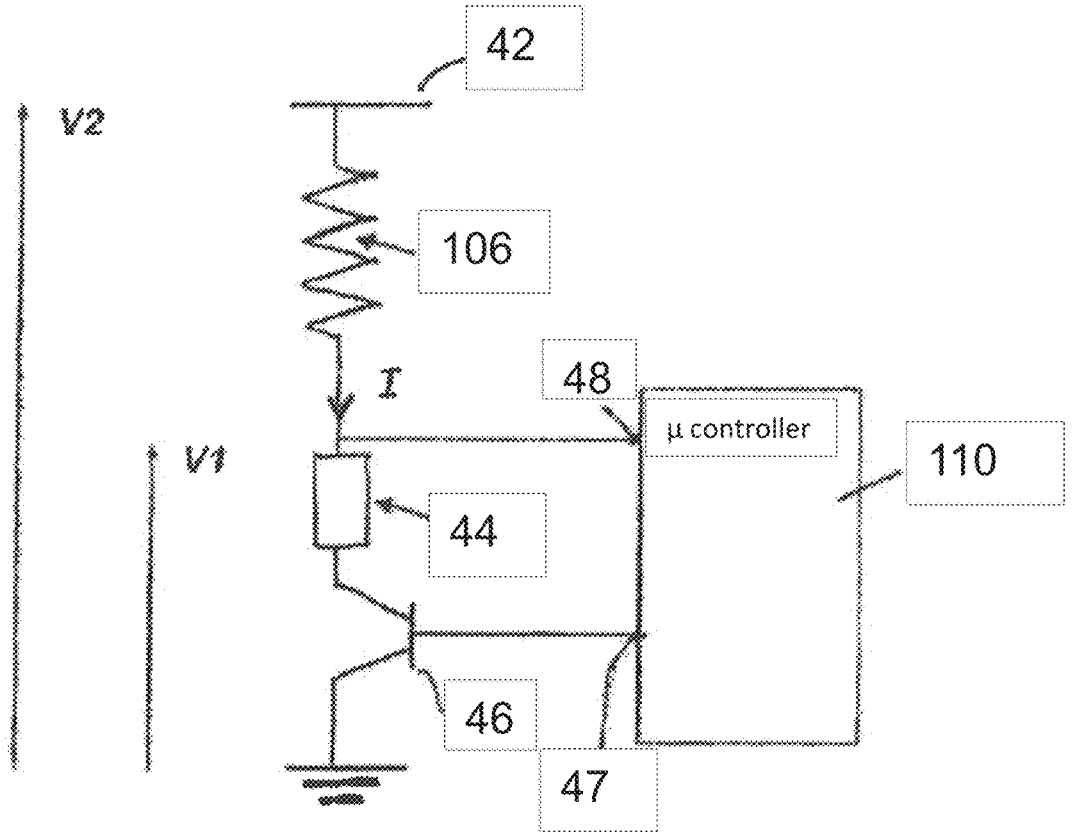
FIG. 4 shows control circuitry used to provide the described power control in accordance with an embodiment of the invention.

FIG. 4 illustrates control circuitry used to provide the described power control in accordance with one embodiment of the invention.

The heating element 106 is connected to the battery through connection 42. The battery (not shown in FIG. 4) provides a voltage V2. In series with the heating element 106, an additional resistor 44, with known resistance r, is inserted and connected to voltage V1, intermediate between ground and voltage V2. The frequency modulation of the current is controlled by the microcontroller 110 and delivered via its analogue output 47 to the transistor 46 which acts as a simple switch.

During the preheating mode, the microcontroller controls the duty cycle in accordance with a predetermined schedule, as described with reference to FIG. 5. During an operating mode, the regulation may be based on a PID regulator that is part of the software integrated in the microcontroller 110. The temperature (or an indication of the temperature) of the heating element may be determined by measuring the electrical resistance of the heating element. The determined temperature may be used to adjust the duty cycle, in this case the frequency modulation, of the pulses of current supplied to the heating element in order to maintain the heating element at a target temperature or adjust the temperature of the heating element towards a target temperature. The temperature is determined at a frequency chosen to match the control of the duty cycle, and may be determined as often as once every 100 ms. The specific embodiments and examples described above illustrate but do not limit the invention. It is to be understood that other embodiments of the invention may be made and the specific embodiments and examples described herein are not exhaustive.

The invention claimed is:

1. A method of controlling a heater in an aerosol-generating device, the method comprising the steps of:

controlling power provided from a power source in the aerosol-generating device to at least one heating element of the heater in the aerosol-generating device, such that in a first phase, power is provided to the at least one heating element to increase a temperature of the at least one heating element from an initial temperature to a first temperature, and in a second phase, power is provided to the at least one heating element to decrease the temperature of the at least one heating element below the first temperature to a second temperature, wherein the power provided to the at least one heating element during the first phase is increased at least once during a duration of the first phase, and wherein aerosol is produced during the second phase.

2. The method according to claim 1, wherein the first phase has predetermined duration.

3. The method according to claim 1, wherein in the first phase:

for a first period of time, power P1 is provided to increase the temperature of the heating element, for a second period of time, power P2 is provided to increase the temperature of the heating element, where P2 >P1, and for a third period of time, power P3 is provided to increase the temperature of the heating element, where P3 >P2.

4. The method according to claim 1, wherein in the first phase, the power provided to the heating element gradually increases, and wherein the first phase ends after a predetermined period of time.

5. The method according to claim 1, wherein during the second phase, when the second temperature of the heating element is achieved, the power is provided to the heating element so that the temperature of the heating element is maintained substantially at the second temperature.

6. The method according to claim 1, wherein in the second phase, the second temperature is maintained for a predetermined period of time shorter than a duration of the second phase, and after the predetermined period of time, the power is provided to the heating element such that the temperature of the heating element drops below the second temperature to a third temperature.

7. The method according to claim 1, wherein the first temperature is between 280° C. and 300° C., and the second temperature is between 140° C. and 200° C.

8. The method according to claim 1, wherein the aerosol-generating device further comprises a cartridge containing the aerosol-forming substrate in a form of a liquid.

9. The method according to claim 1, wherein the step of controlling power provided to the heating element comprises providing the power to the heating element in pulses.

10. The method according to claim 9, wherein the power provided to the heating element during the first phase is increased by altering a duty cycle of the pulses provided to the heating element.

11. An electrically operated aerosol-generating device, comprising:

at least one heating element configured to heat an aerosol-forming substrate to generate an aerosol;

a power supply configured to supply power to the at least one heating element; and electric circuitry, comprising a controller, configured to control a supply of power from the power supply to the at least one heating element, wherein the electric circuitry is arranged to:

control power supplied to the at least one heating element such that in a first phase, the power is provided such that a temperature of the at least one heating element increases from an initial temperature to a first temperature, and in a second phase, the power is provided such that the temperature of the at least one heating element drops below the first temperature to a second temperature, wherein the power provided to the at least one heating element during the first phase is increased at least once during a duration of the first phase, and wherein aerosol is produced during the second phase.

12. An aerosol-generating system comprising an electrically operated aerosol-generating device according to claim 11 and a cartridge containing an aerosol-forming substrate, the cartridge being configured to engage the electrically operated aerosol-generating device so that at least one heating element of the electrically operated aerosol-generating device is configured to heat the aerosol-forming substrate of the cartridge.

13. The aerosol-generating system according to claim 12, wherein the cartridge comprises a first compartment and a second compartment, and wherein the aerosol-forming substrate comprises a liquid nicotine source contained in the first compartment and a liquid acid source contained in the second compartment.

14. A method of controlling an electrical heating element in an aerosol-generating device, the method comprising:

controlling power provided from a power source in the aerosol-generating device to at least one heating element of a heater in the aerosol-generating device, in a preheating mode comprising providing power to the at least one heating element to increase a temperature of the at least one heating element from an initial temperature to a preheating target temperature, wherein the power provided in the preheating mode is increased according to a predetermined power profile.

15. The method according to claim 14, wherein the predetermined power profile comprises either:

increasing the power provided to the at least one heating element in a plurality of steps, each step having a predetermined duration, or increasing the power provided to the at least one heating element at a predetermined rate.

* * * * *